US006776358B2

(12) United States Patent
Arimoto

(10) Patent No.: US 6,776,358 B2
(45) Date of Patent: Aug. 17, 2004

(54) FUEL INJECTION NOZZLE FOR A DIESEL ENGINE

(76) Inventor: Jun Arimoto, Corner House, Wyatts Road, Chorleywood Rickmansworth, Hertfordshire WD3 5TE (GB)

( * ) Notice: Subject to any disclaimer, the term of this patent is extended or adjusted under 35 U.S.C. 154(b) by 343 days.

(21) Appl. No.: 10/020,170

(22) Filed: Dec. 18, 2001

(65) Prior Publication Data

US 2002/0092929 A1 Jul. 18, 2002

Related U.S. Application Data

(63) Continuation-in-part of application No. 09/555,963, filed on Jun. 7, 2000.

(30) Foreign Application Priority Data

Oct. 9, 1998 (JP) ..... PCT/JP98/04566

(51) Int. Cl.[7] ..... F02M 39/00

(52) U.S. Cl. ..... 239/533.3; 239/533.9; 239/581.1; 239/581.2; 239/582.1

(58) Field of Search ..... 239/533.3, 533.9, 239/581.1, 581.2, 582.1

(56) References Cited

U.S. PATENT DOCUMENTS 5,947,389 A 9/1999 Hasegawa et al. ..... 239/533.2

5,975,433 A 11/1999 Hasegawa et al. ..... 239/533.12

FOREIGN PATENT DOCUMENTS

| | | |
|---|---|---|
| JP | 4-76266 | 3/1992 |
| JP | 9-280134 | 10/1997 |
| JP | 10-184495 | 7/1998 |
| WO | WO 96/41948 | 12/1996 |

*Primary Examiner*—Christopher Kim
(74) *Attorney, Agent, or Firm*—Finnegan, Henderson, Farabow, Garrett & Dunner, L.L.P.

(57) ABSTRACT

A fuel injection nozzle is provided for a diesel engine. The fuel injection nozzle includes a nozzle body having a tip end portion, a top end portion having an opening edge, and a fuel inlet passage, a needle valve inserted in the nozzle body, and a bag-shaped rotary valve fitted with the tip end portion of the needle valve. The nozzle body has a first protrusion protruding from an inner peripheral surface toward a center axis of the nozzle body. The needle valve has a first guide groove being engaged with the first protrusion and a second guide groove. The rotary valve has a second protrusion protruding toward the center axis and being engaged with the second guide groove. This fuel injection nozzle may realize good combustion performance and good exhaust emission performance. Also the fuel injection nozzle may have a simple structure without increasing the size of the injector assembly.

11 Claims, 7 Drawing Sheets

FUEL INJECTION NOZZLE FOR A DIESEL ENGINE

CROSS REFERENCE TO RELATED APPLICATION

The present application is a continuation-in-part of U.S. patent application Ser. No. 09/555,963, filed Jun. 7, 2000, the complete disclosure of which is incorporated herein by reference in its entirety.

DESCRIPTION OF THE INVENTION

1. Field of the Invention

The present invention relates to a fuel injection nozzle for a diesel engine. More particularly, the invention is directed to a fuel injection nozzle having a needle valve.

2. Background of the Invention

A fuel injection nozzle of a diesel engine, especially a direct-injection type engine, generally has a needle valve inserted in a nozzle body having a plurality of nozzle holes. When fuel is introduced to a fuel inlet passage formed within the nozzle body, the needle valve is lifted by fuel pressure so that the fuel passes through a gap formed between a surrounding wall of the needle valve and an inner wall of the nozzle body. The fuel is then injected through the plurality of nozzle holes into a combustion chamber (piston cavity) of the engine.

The opening area of each nozzle hole, in the conventional diesel engine fuel injection nozzle, is fixed. When the fuel pressure is high, i.e., in a high-load state, sufficiently high spray penetration can be attained. However, when the fuel pressure is low, i.e., in a low-load state, the spray penetration is reduced, and the fuel will not be sufficiently atomized. Therefore, the fuel will be combusted before it is sufficiently mixed with air. This causes longer ignition delay, increases combustion noise, deteriorates exhaust emission performance, and causes smoke problems.

A rotary valve having a fuel passage is known to be used for throttling fuel through the nozzle. The rotary valve is rotated by a pulse motor or the like. During the low-load state, a nozzle hole area is throttled, and spray penetration of the fuel is increased. However, a pulse motor increases the size of the fuel injector assembly and its manufacturing cost. Furthermore, the structure of the injector assembly becomes complex, decreasing the reliability of the injector assembly.

The present invention is directed to solving the above-mentioned problems of the conventional fuel injection nozzle by attaining good combustion performance and good exhaust emission performance. Moreover, the present invention is also directed to achieving such performance by a fuel injection nozzle having a simple structure without increasing the size of the injector assembly. Also, the present invention may reduce the size of the piston cavity, thereby enabling reduction of the engine size as a whole by effectively utilizing the spray penetration to mix the fuel with the air.

SUMMARY OF THE INVENTION

In accordance with the invention, a fuel injection nozzle is provided for a diesel engine. The fuel injection nozzle includes a nozzle body having a tip end portion, a top end portion having an opening edge, and a fuel inlet passage, the tip end portion having a plurality of first nozzle holes. The nozzle body has a first protrusion formed on a peripheral wall adjacent to the opening edge, and the first protrusion protrudes from an inner peripheral surface toward a center axis of the nozzle body. The fuel injection nozzle also includes a needle valve inserted in the nozzle body. The needle valve has a tip end portion, a top end portion, a first guide groove formed on an outer peripheral surface at the top end portion of the needle valve and inclining in a direction with respect to an axial direction of the needle valve, and a second guide groove formed on an outer peripheral surface of the tip portion of the needle valve and inclining in an opposite direction to the first guide groove with respect to the axial direction. The tip end portion has a gap with respect to the tip portion of the nozzle body, and the first guide groove is engaged with the first protrusion allowing the needle valve to axially rotate corresponding to a movement of the needle valve in the axial direction. The fuel injection nozzle includes a bag-shaped rotary valve fitted with the tip end portion of the needle valve. The rotary valve has a second protrusion protruding toward the center axis and being engaged with the second guide groove. The rotary valve has a plurality of second nozzle holes configured to have an overlapping area with the plurality of first nozzle holes. The overlapping area increases as the rotary valve rotates due to the movement of the needle valve in the axial direction.

In another aspect, a fuel injection nozzle of a diesel engine is provided with a first serration formed on an inner peripheral surface of a guide ring fitted to a groove formed on the opening edge of the nozzle body. The guide ring is prohibited from rotation, and the first serration inclines with respect to the axial direction. The nozzle also includes a second serration formed on an outer peripheral surface at the top end portion of the needle valve. The second serration is engaged with the first serration allowing the needle valve to rotate corresponding to movement of the needle valve in the axial direction. A tip portion on a nozzle hole side of the needle valve has a gap with respect to an inner surface of a tip portion on the nozzle hole side of the nozzle body. The tip portion of the nozzle hole side of the nozzle valve is fitted with a bag-shaped rotary valve. A third serration and a fourth serration are formed on an outer peripheral surface at the tip portion of the needle valve and on an inner peripheral surface of the rotary valve, respectively. The third serration and the fourth serration are engaged with each other with a gap therebetween and incline in a direction opposite to the first and second serrations with respect to the axial direction. A plurality of second nozzle holes are formed such that an overlapping area of the plurality of second nozzle holes with the plurality of first nozzle holes formed in the nozzle body increases the lifting of the needle valve in the axial direction.

In yet another aspect, a fuel injection nozzle for a diesel engine includes a nozzle body having a tip end portion, a top end portion having an opening edge, and a fuel inlet passage. The tip end portion has first nozzle holes. A guide ring is fitted at the opening edge and has a first serration substantially inclined with respect to an axial direction. A needle valve is inserted in the nozzle body and has a tip end portion, a top end portion, a second serration formed at the top end portion thereof, and a third serration at the tip end portion thereof. The second serration is engaged with the first serration. The first and second serrations allow the needle valve to rotate and move in the axial direction creating a first gap between the nozzle body and the needle valve when fuel is introduced through the fuel inlet passage. A rotary valve is disposed between the tip end potion of the needle valve and the tip end portion of the nozzle body. The rotary valve has second nozzle holes in the tip end portion thereof and a fourth serration. The second nozzle holes are configured to have an overlapping area with the first nozzle holes, and the overlapping area increases as the needle valve is lifted in the axial direction. The fourth serration is engaged with the third serration with a second gap therebetween and is inclined in a direction opposite to the first and second serrations with respect to the axial direction.

Additional objects and advantages of the invention will be set forth in part in the description which follows, and in part will be obvious from the description, or may be learned by practice of the invention. The objects and advantages of the invention will be realized and attained by the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention.

FIGS. 3A–D show a cross-sectional view along the line A—A and a view from the arrow B of the fuel injection nozzle of FIG. 1 or FIG. 2, and the sprayed state of fuel in a combustion chamber according to each operating position of the fuel injection nozzle, wherein FIG. 3A shows the closed valve state, FIG. 3B shows the low-load (idle) state where the nozzle hole is slightly opened, FIG. 3C shows the mid-load state where the nozzle hole is half opened, and FIG. 3D shows the full-load state where the nozzle hole is fully opened;

DESCRIPTION OF THE EMBODIMENTS

Reference will now be made in detail to exemplary embodiments of the invention, which are illustrated in the accompanying drawings. Wherever possible, the same reference numbers will be used throughout the drawings to refer to the same or like parts.

Figure 1:
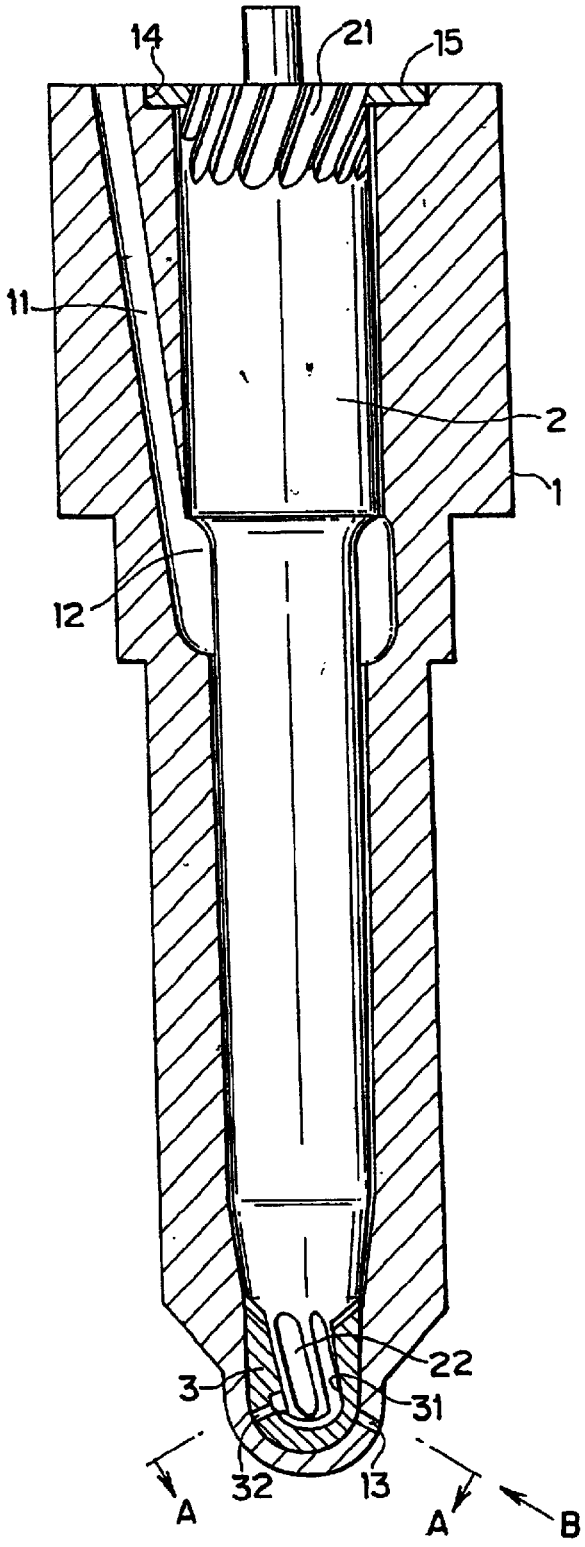
FIG. 1 is a vertical cross-sectional view of a fuel injection nozzle in the closed state according to one embodiment of the present invention.
Figure 2A:
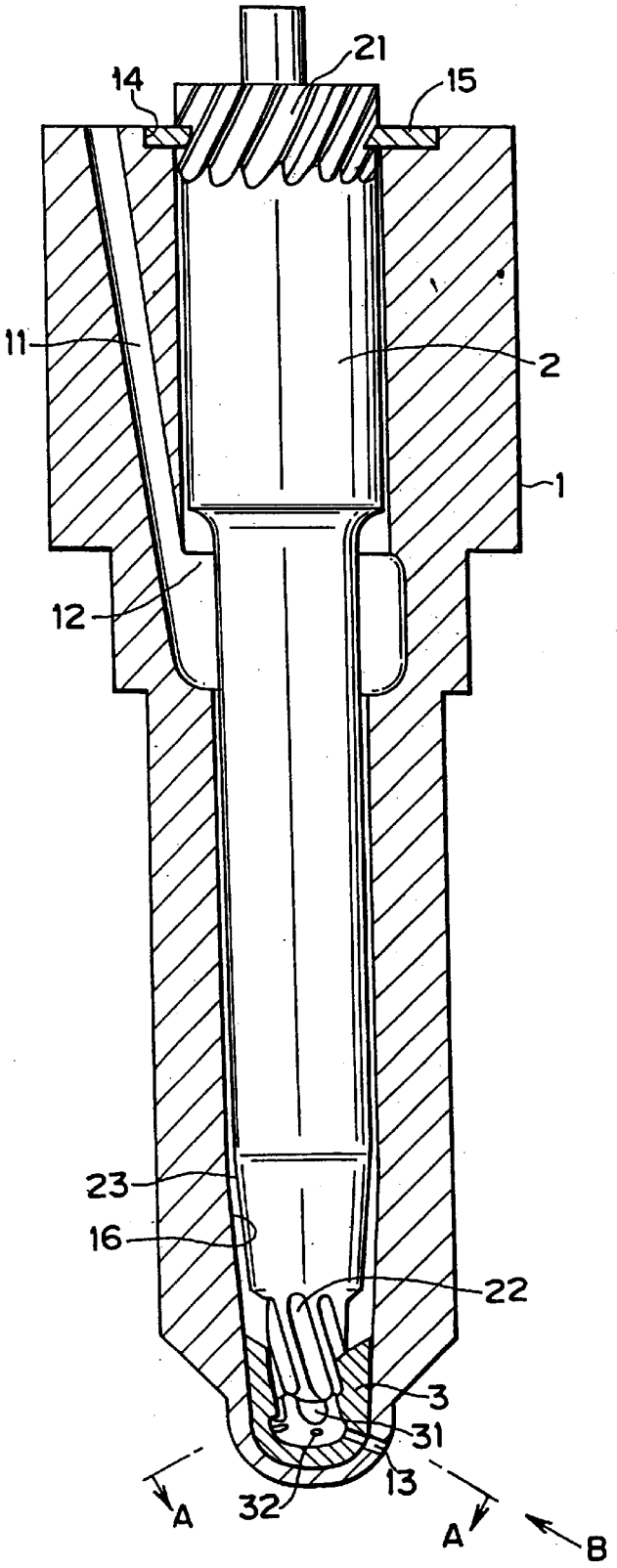
FIG. 2A is a vertical cross-sectional view of the fuel injection nozzle of FIG. 1 in the open state.

FIG. 1 (valve closed) and FIG. 2 (valve opened) show a structure of a tip portion of a fuel injection nozzle of a diesel engine according to the present invention. A nozzle body 1 is turned along the axial direction of the nozzle body 1 to be engaged with a nozzle holder (not shown in the figures), and the nozzle body 1 is firmly connected to the nozzle holder by a bolt and a nut or any other suitable connector.

The nozzle body 1 includes a fuel inlet passage 11 that communicates with a fuel passage formed in the nozzle holder. The fuel inlet passage 11 is in fluid communication with a fuel pool 12 formed at the inner peripheral surface in the middle area of the nozzle body 1. Furthermore, a plurality of nozzle holes (first nozzle holes) 13 are formed on the tip portion of the nozzle body 1 with intervals in the peripheral direction.

Figure 2B:
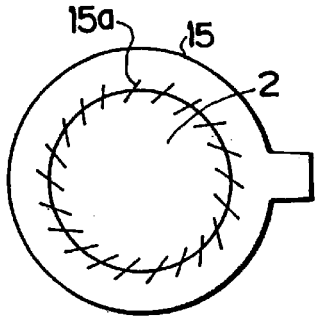
FIG. 2B is a partial top view of the fuel injection nozzle of FIG. 2A.

A groove 14 is formed on the opening edge on the top end portion side of the nozzle body 1. Furthermore, the fuel injection nozzle has a guide ring 15. As shown in FIG. 2B, the guide ring 15 includes a first serration 15*a* formed on the inner peripheral surface of the ring 15, and the first serration 15*a* is inclined with respect to the axial direction of the fuel injection nozzle. The guide ring 15 is prevented from free axial rotation and is fitted to the groove 14, as shown in the figures.

A needle valve 2 is inserted and fixed in the interior of the nozzle body 1. A second serration 21 is formed to the outer peripheral surface at the top end portion of the needle valve 2. The second serration 21 is engaged with the first serration 15*a* of the guide ring 15, and allows the needle valve 2 to axially rotate corresponding to the movement of the needle valve 2 in the axial direction.

The tip portion of the needle valve 2 on the nozzle hole side is formed to have a gap with the inner surface on the nozzle hole side of the tip portion of the nozzle body 1. A bag-shaped rotary valve 3, which fits to the tip portion of the needle valve 2, is disposed in the gap.

Furthermore, a third serration 22 and a fourth serration 31 are formed to the outer peripheral surface at the tip portion of the needle valve 2 and to the inner peripheral surface of the rotary valve 3, respectively. The third and fourth serrations are engaged with each other with a gap therebetween and are inclined in the opposite direction to the first serration 15*a* and the second serration 21 with respect to the axial direction of the fuel injection nozzle.

The gap between the third serration 22 and the fourth serration 31 is formed only in the area between peaks of protrusions and troughs of the groove along the longitudinal direction of the serration, so that fuel may pass through the gap. Since a minimal clearance gap is formed in the circumferential direction of the valve 3, the valve 3 is prevented from rattling during rotation.

A plurality of nozzle holes 32 (second nozzle holes) are formed to the rotary valve 3, in the area closer to the nozzle holes 13 than the fourth serration 31. The plurality of nozzle holes 32 and the plurality of nozzle holes 13 (first nozzle holes) formed in the nozzle body 1 have an overlap that increases depending on the rotation amount of the rotary valve 3, which increases as the lifting amount of the needle valve 2 in the axial direction increases.

Each of the nozzle holes 32 (second nozzle holes) formed in the rotary valve 3 has an elongated oblong shape (with both ends formed in a round shape), in the rotating direction of the rotary valve 3. Each of the nozzle holes 13 (first nozzle holes) of the nozzle body 1 has a round shape, having a larger diameter than the narrow side width of the nozzle holes 32 (second nozzle holes).

Furthermore, cone-tapered surfaces 23, 16 are formed in the needle valve 2 in the area closer to the base end portion than the third serration 22, and to the inner peripheral surface of the nozzle body 1 in the area closer to the base end portion than the area disposing the rotary valve 3 therein, respectively. The two surfaces 23, 16 contact each other when the needle valve is not lifted.

The operation of the fuel injection nozzle will now be explained.

When the fuel injection nozzle is closed, or when a fuel supply pressure applied to the fuel inlet passage 11 is low so that no fuel injection is performed, a return spring (not shown in the figures) biases the needle valve 2 toward the nozzle hole side. The cone-tapered surface 23 of the needle valve 2 and the cone-tapered surface 16 of the nozzle body 1 will be pressurized to contact each other, and the communication between the fuel inlet passage 11 and the nozzle hole side is completely shut off.

Figure 3A:
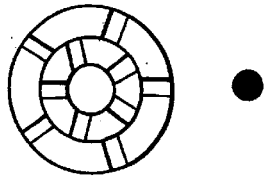

Further, when the nozzle is closed, as shown in FIG. 3(A), the rotary valve 3 is set in a rotating position so that the nozzle holes 13 (first nozzle holes) and the nozzle holes 32 (second nozzle holes) are not overlapped at all. This structure of the valve enables to maintain a reliably closed state, preventing problems such as subsequent dripping and the like.

When fuel is supplied to the fuel inlet passage 11 under a pressure equal to or over a predetermined value, the fuel pressure is received by a stepped pressure receiving surface at the fuel pool 12 of the needle valve 2. Thereby, the needle valve 2 is lifted in the axial direction, against the bias force of the return spring (not shown in the figures).

When the needle valve 2 is lifted, the needle valve 2 axially rotates in one direction, since the first serration 15*a* and the second serration 21 are engaged with each other. Further, the rotary valve 3, the lifting of which is limited by the fuel pressure (as explained in detail later), axially rotates relative to the needle valve 2 in the same direction as the rotating direction of the needle valve 2 due to the engagement of the third serration 22 and the forth serration 31. In other words, the rotary valve axially rotates by the total amount of rotation obtained by adding the rotation amount caused by the engagement of the first serration and second serration and one caused by the engagement of the third serration and fourth serration.

By the axial rotation of the rotary valve 3 explained above, the nozzle holes 32 and the nozzle holes 13 overlap. The overlapped area increases as the lifting amount of the needle valve 2 increases due to the increase of fuel pressure. Thus, during the idle state or in the low-load region where the fuel pressure is low, the overlapped area is controlled to be small. As the fuel pressure increases with the increase of load, the overlapped area is controlled to increase as well.

Further, when the needle valve 2 is lifted, the cone-tapered surfaces 23, 16 separate from each other, and the fuel is introduced through the gap formed between the needle valve 2 and the nozzle body 1 to the nozzle hole side. The fuel further passes through the gap formed between the third serration 22 and the fourth serration 31, and reaches the inner space of the rotary valve 3, where it is sprayed through the overlapped portion of the nozzle holes 32 and the nozzle holes 13 into a combustion chamber.

Figure 3B:
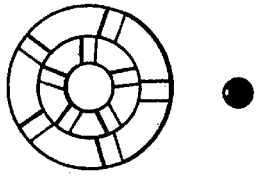
Figure 3B:
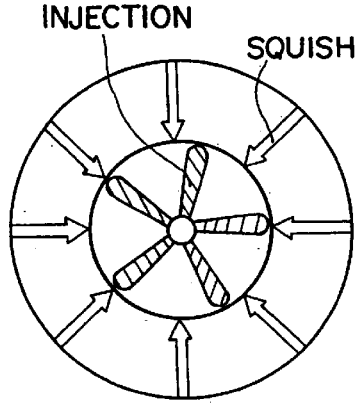

During the idle state or in the low-load region where the fuel pressure is low, the overlapped area of the nozzles is controlled to be small, as shown in FIG. 3B, to increase spray penetration of the fuel, so that atomization of the fuel is promoted. Since the amount of air with which the atomized fuel contacts increases as well, the fuel will mix with air rapidly and sufficiently before being combusted. Particularly, according to the present embodiment, each of the inner nozzle holes 32 opens in a shape of elongated oblong in the rotating direction of the rotary valve 3, and each of the outer nozzle holes 13 opens in a round shape having a larger diameter than the narrower width of the nozzle holes 32. This enables the sprayed fuel to diffuse in a flat manner in the circumferential direction. Therefore, the fuel efficiently collides with the pressure generated within the combustion chamber during the compression stroke, so that the fuel may be effectively mixed with air.

According to this construction, it is possible to minimize ignition delay, to obtain good combustion performance, and to improve quietness and exhaust emissions performance (especially, smoke).

Figure 3C:
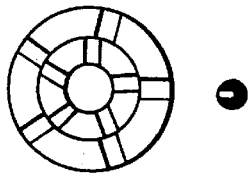
Figure 3C:
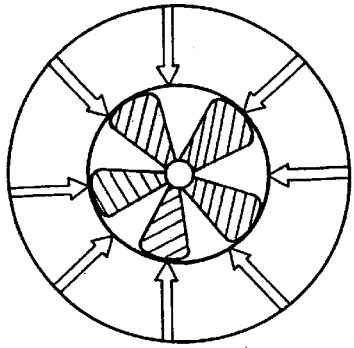
Figure 3D:
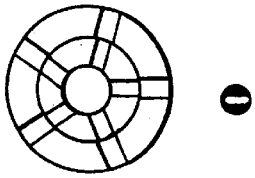
Figure 3D:
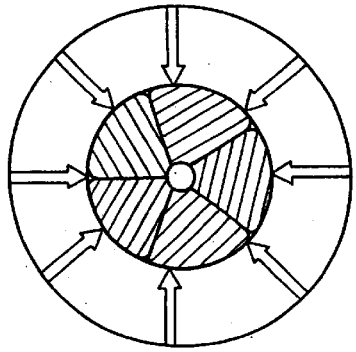

Further, as the load increases and the fuel injection quantity increases, the overlapped area of the nozzle holes increases continuously. Therefore, the injection zone is enlarged while the spray penetration of the fuel is maintained, and the fuel contacts and mixes with air of the amount corresponding to the fuel injection quantity. Accordingly, the best fuel atomization is obtained throughout the whole area with fuel and air mixed well, which brings the good combustion performance and good exhaust emissions performance. FIG. 3(C) shows the state where the overlap between the nozzle holes is approximately 50%, and FIG. 3(D) shows the full-load state where the nozzle holes are 100% overlapped.

According to the present embodiment, only a design modification is made by adding to the conventional type fuel injection nozzle structure, four types of serrations, a groove 14, and disposing a guide ring 15, a guide ring spring 33, and a rotary valve 3, to provide the fuel injector without increasing the size of the injector at low cost with high reliability, since there is no need to add a separate driving device such as a pulse motor or the like to the valve structure.

Even further, the present embodiment is the system for mainly utilizing pressure (squish) to enhance the mixing of fuel and air and to extend the fuel spray travel. Therefore, by applying an intake port that ensures intake air quantity to the utmost without considering the induction swirl, the cavity may be designed to be shallower, and also, the piston height or the engine height can be reduced. Further, by maintaining even more air within the combustion chamber, the fuel injection quantity can be increased and the specific power can be increased.

Figure 4A:
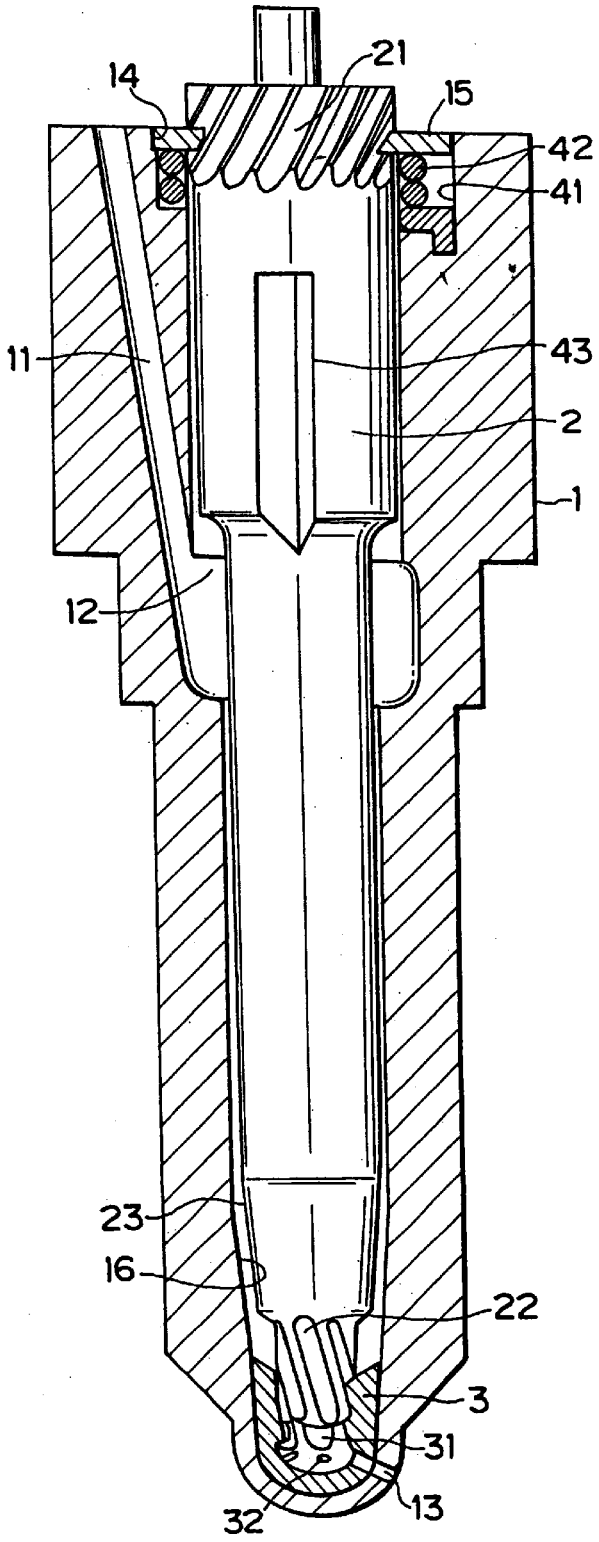
FIG. 4A is a vertical cross-sectional view of a fuel injection nozzle according to a second embodiment of the present invention.
Figure 4B:
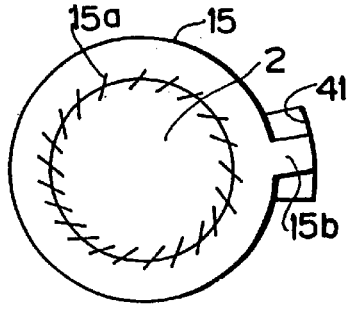
FIG. 4B is a partial top view of the fuel injection nozzle of FIG. 4A.
Figure 4C:
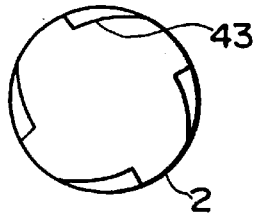
FIG. 4C is a partial cross-sectional view of the fuel injection nozzle of FIG. 4A.

Next, a second embodiment of the present invention will be explained with reference to FIG. 4. In FIG. 4, the same reference numbers designate to the same components as those of FIG. 1.

According to the present embodiment, a groove 41 for engaging the guide ring 15 is formed on the opening edge on the top end portion side of the nozzle body 1 to have an area, with which a protrusion 15*b* of the guide ring 15 is engaged, larger in the circumferential direction than the width of the protrusion 15*b* of the guide ring 15 in the circumferential direction, so that the guide ring 15 rotates in a predetermined angle. The groove 41 further has a large depth in the axial direction so as to accommodate a guide ring spring 16, to be explained later.

A guide ring spring 42 comprising a torsion coil spring is mounted within the groove 41 below the guide ring 15. The spring 42 has one end engaged with the guide ring 15 and the other end positioned and fit within the groove 41, so as to bias the guide ring 15 to a direction (clockwise in the upper view) opposite to the rotating direction of the needle valve 2 when the valve 2 is lifted in the axial direction.

Moreover, a plurality of slits 43 are formed with even intervals in the circumferential direction of the side wall of the needle valve 2. The cross-sectional shape of each of the slits 43 is formed in a windmill-shaped, with each slit formed to increase in depth toward the rotating direction of the needle valve 2 when the valve 2 is lifted in the axial direction. The windmill-shaped slits 43 operate rotatably to force the needle valve 2 in the rotating direction (counterclockwise in the upper view), by the pressure of the fuel received through the fuel pool 12. The other components of the valve are the same as those of embodiment 1.

According to this construction, as the fuel pressure received by the slits 43 of the needle valve 2 via the fuel pool 12 increases, the rotary force acting on the needle valve 2, when the needle valve 2 is lifted in the axial direction, increases so that the guide ring 15 rotates in the same direction as the rotating direction, against the bias force of the guide ring spring 42, to allow the needle valve 2 to rotate integrally in the same direction with the guide ring 15.

Even if there is not much space for the needle valve 2 to be lifted, the rotation amount may be ensured greatly in proportion to the fuel pressure. Simultaneously, the guide ring 15, the needle valve 2 and the rotary valve 3 can rotate and be maintained at the closed valve position by the operation of the guide ring spring 42, when the fuel injection nozzle is closed where the fuel pressure is low.

Figure 5:
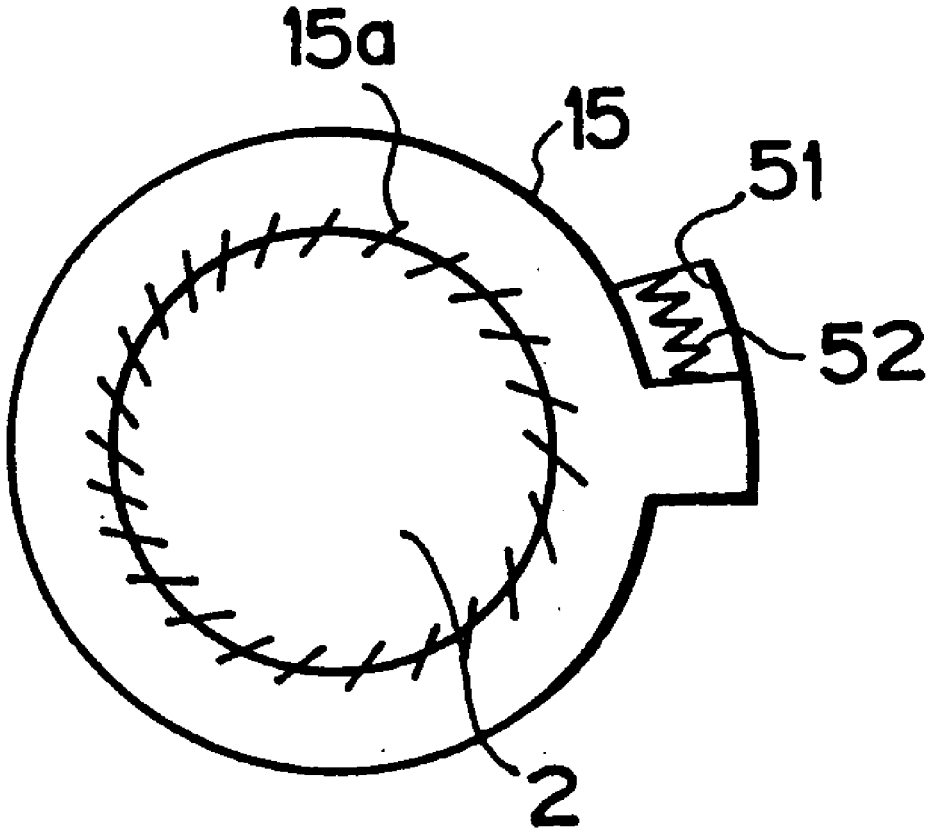
FIG. 5 is a partial top view of the fuel injection nozzle of the second embodiment of the present invention with a modification.
Figure 6A:
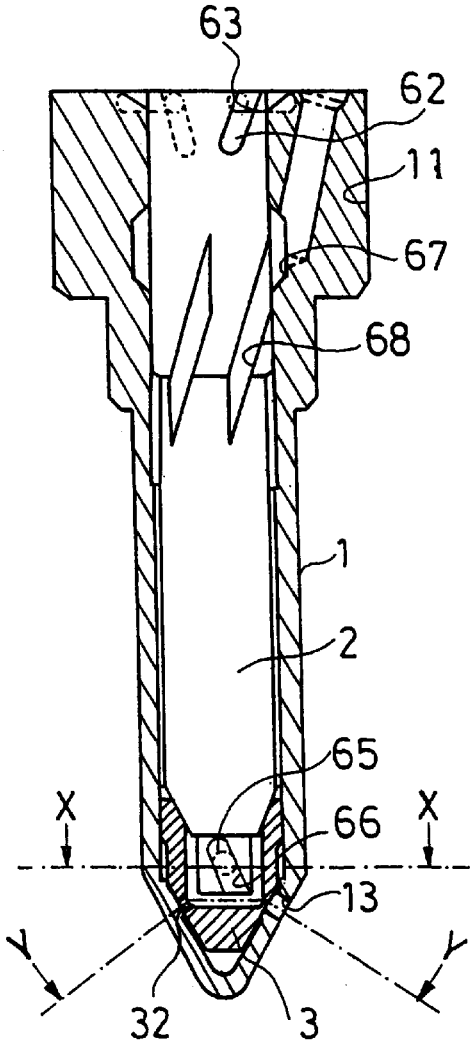
FIG. 6A is a vertical cross-sectional view of a fuel injection nozzle at the closed state according to another embodiment of the invention.
Figure 6B:
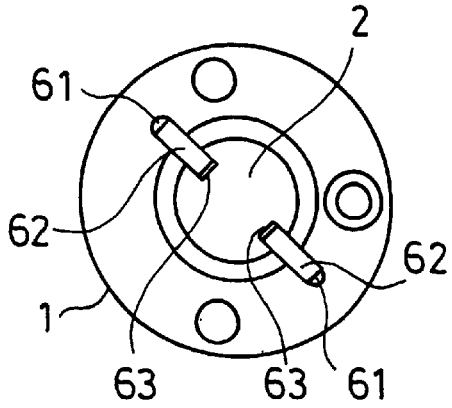
FIG. 6B is a top view of the fuel injection nozzle in FIG. 6A.
Figure 6C:
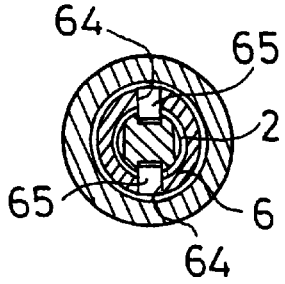
FIG. 6C is a cross-sectional view of the fuel injection nozzle in FIG. 6A along the line X—X.
Figure 6D:
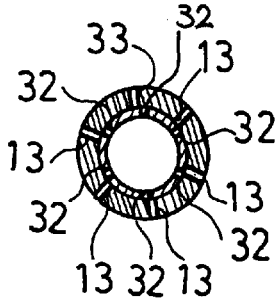
FIG. 6D is a cross-sectional view of the fuel injection nozzle in FIG. 6A along the line Y—Y.
Figure 6E:
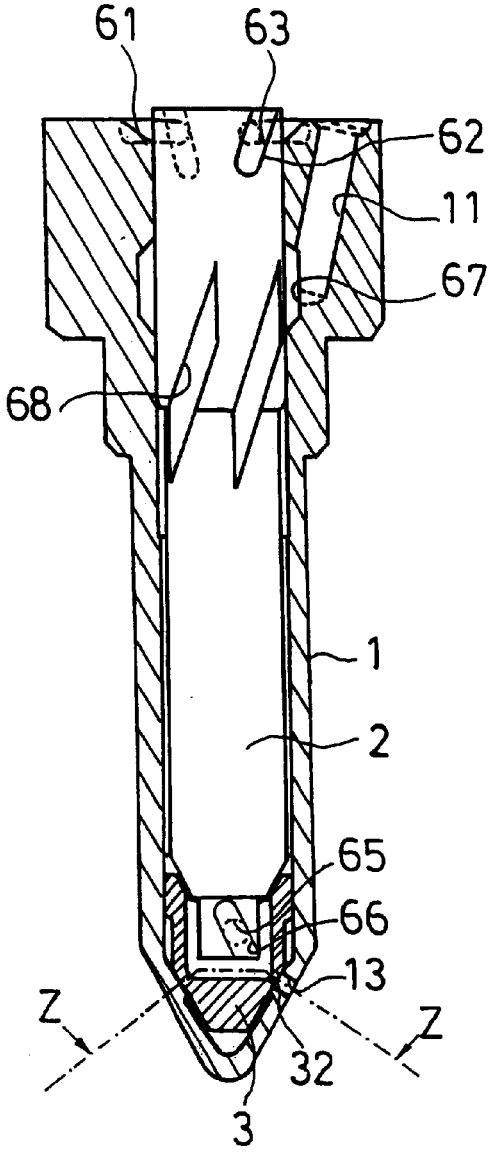
FIG. 6E is a vertical cross-sectional view of the fuel injection nozzle in FIG. 6A in the open state.
Figure 6F:
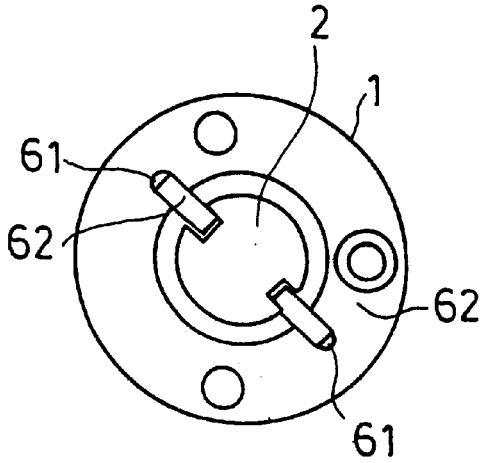
FIG. 6F is a top view of the fuel injection nozzle in FIG. 6E.
Figure 6G:
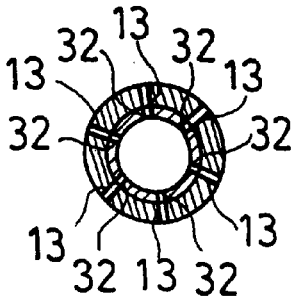
FIG. 6G is a cross-sectional view of the fuel injection nozzle along the line Z—Z in FIG. 6E.

FIG. 5 shows a modification of the second embodiment. A groove 51 for engaging the guide ring 15 is formed on the opening edge of the nozzle body 1, to have an area, with which the protrusion 15*b* of the guide ring 15 is engaged, larger in the circumferential direction than the width of the protrusion 15*b* of the guide ring 15 in the circumferential direction, so that the guide ring 15 axially rotates in a predetermined angle. A guide ring spring 52, which biases the guide ring 15 to a direction opposite to the rotating direction of the needle valve 2 when the valve 2 is lifted, is mounted to the area to which the protrusion 15*b* of the guide ring 15 is fit. The guide ring spring 52 may be formed of a plate spring and the like.

According to this construction, the needle valve inserted within the nozzle body is lifted in the axial direction by the fuel pressure, when fuel is introduced through the fuel inlet passage formed within the nozzle holder and the nozzle body. Due to the engagement of the first serration and the second serration, the needle valve axially rotates in one direction. Simultaneously, due to the engagement of the third serration and the fourth serration, the rotary valve the lifting amount of which is limited by the fuel pressure axially rotates relative to the needle valve in the same rotating direction as the needle valve.

In other words, the rotary valve axially rotates by the total amount obtained by adding the rotation amount caused by the engagement of the first serration and second serration, and the rotation amount caused by the engagement of the third serration and fourth serration. Further, the rotation amount of the rotary valve is small in the low-load region where the fuel injection quantity is low, since fuel pressure is low and the lifting amount of the needle valve is also small. On the other hand, the rotation amount of the rotary valve increases, as the fuel pressure increases and the lifting amount of the needle valve increases with the increase of the load.

Then, in response to the increase of the rotation amount of the rotary valve, the overlapped area of the first nozzle holes and the second nozzle holes increases.

After passing through the gap between the needle valve and the nozzle body, the fuel travels through the gap between the third serration and the fourth serration, and reaches the interior of the rotary valve. Then, the fuel is injected into the combustion chamber through the overlapped area of the second nozzle holes formed in the rotary valve and the first nozzle holes formed in the nozzle body.

Here, in the low-load region where the fuel pressure is low, by making the overlapped area of the nozzle holes small, the spray penetration of the fuel increases so that the atomization of fuel is promoted, and the amount of air with which the atomized fuel contacts is increased. Therefore, the fuel may rapidly and sufficiently mix with air. Thereby, it is possible to minimize the ignition delay, to obtain good the combustion performance and to improve the quietness and the exhaust emission (especially smoke) performance.

Further, as the load increases and the fuel injection quantity and pressure increases, the overlapped area of the nozzle holes increases continuously. Therefore, the fuel injection zone is enlarged while the spray penetration of the fuel is maintained, and the fuel contacts and mixes with air of the amount corresponding to the fuel injection quantity. Accordingly, the best fuel atomization is obtained throughout the whole region with fuel and air mixed well, which brings good combustion performance and improved exhaust emissions performance.

Further, the above-mentioned improvement of performance can be realized by a fuel injector having a simple structure without increasing the size of the valve body, only by forming an automatic and mechanical rotary structure driven by the fuel pressure without mounting a separate driving device such as pulse motor.

Moreover, even when the maximum lifting amount of the needle valve is limited to be relatively small, the rotary valve may be made to rotate by a large rotation amount obtained by adding the rotation amount caused by the engagement of the first and second serrations, and the rotation amount caused by the engagement of the third and fourth serrations. Accordingly, the dynamic range of the overlapped area of the nozzle holes may be made to be sufficiently large, to obtain the optimum overlapped area depending on the load.

Further, each of the second nozzle holes may open in a shape of elongated ellipse in the rotating direction of the rotary valve, and each of the first nozzle holes may open in a round shape having a larger diameter than the narrower width of the second nozzle holes.

According to this construction, the sprayed fuel through the first nozzle holes diffuses in flat in the circumferential direction, to collide efficiently with the squish generated within the combustion chamber during the compression stroke, so that the fuel may be effectively mixed with the air. This enables to improve the combustion performance, the quietness and the exhaust emissions performance.

Moreover, since the amount of fuel atomized to diffuse toward the circumferential direction increases corresponding to the increase of fuel injection quantity, the fuel may be made to contact well with squished air of the amount corresponding to the fuel injection quantity, so that a good mixture condition can be obtained throughout the whole operating region.

Even further, the present invention provides a system for mainly utilizing the strong spray penetration and the pressure (squish) to enhance the mixing of fuel and air.

Therefore, the height of the cavity may be reduced, and also, the piston height and the engine height may also be reduced.

Further, the first serration may be formed to the inner peripheral surface of a guide ring that is prohibited the axial rotation to be fit to a groove formed on the opening edge of the nozzle body.

Although the first serration can be worked directly to the opening edge of the nozzle body, the working accuracy is hard to be improved, and the manufacturing cost is increased. Contrary to this, according to the above construction, the guide ring with the first serration formed to the inner peripheral surface thereof, which may be manufactured at low cost, is simply fit to the groove formed by a simple working on the opening edge of the nozzle body, so that the fuel injection nozzle according to the invention having such simple structure may be formed at low cost, and the required level of working accuracy may also be achieved easily.

Moreover, the construction may be such that the first serration is formed in the inner peripheral surface of a guide ring that is fit to a groove formed on the opening edge of the nozzle body and rotates freely in a predetermined angle in the axial direction. A guide ring spring is disposed for biasing the guide ring toward a direction opposite to the rotating direction of the needle valve when the needle valve is lifted in the axial direction. One or more slits are formed in the peripheral wall of the needle valve, increasing the depth toward the rotating direction of the needle valve when the needle valve is lifted in the axial direction, and exert rotary force to the needle valve in the rotating direction by the received fuel pressure.

According to this construction, the rotary force acting on the needle valve in the rotating direction when the needle valve is lifted in the axial direction, increases in response to the increase of fuel pressure received by the slits formed in the peripheral wall of the needle valve, so that the guide ring rotates in the same direction as the rotating direction of the needle valve against the bias force of the guide ring spring, to allow the needle valve to rotate integrally in the same direction with the guide ring.

Even if there is not much space for the needle valve to be lifted, the rotation amount may be ensured greatly in proportion to the fuel pressure. Simultaneously, the guide ring, the needle valve and the rotary valve can securely rotate and be maintained at closed-valve position by the operation of the guide ring spring, when the fuel injection nozzle is closed where the fuel pressure is low.

Further, cone-tapered surfaces may be each formed to the needle valve in the area closer to the base end portion than the third serration portion, and to the inner peripheral surface of the nozzle body in the area closer to the base end portion than the rotary valve, wherein the cone-tapered surfaces contact each other when the needle valve is not lifted.

According to construction, when the fuel injection nozzle is closed, the cone-tapered surfaces formed to the needle valve and the nozzle body contact with each other, thereby preventing the fuel from being communicated to the nozzle holes, to completely shut off the valve.

Next, a third embodiment of the present invention will be explained with reference to FIG. 6. In FIG. 6, the same parts are designated by the same reference numbers as those of the first embodiment.

The third embodiment is different from the first embodiment in that, instead of the guide ring forming the first serration, a first protrusion is formed on a peripheral wall adjacent to an opening edge of the nozzle body 1. The first protrusion protrudes toward the longitudinal axis of the nozzle body 1. The first protrusion includes pins 62 fixedly fitted to grooves 61. The grooves 61 are formed at two portions facing each other with respect to the center axis at an upper edge of the nozzle body 1.

A pair of first guide grooves 63 are formed on the needle valve 2 and are engaged with the pair of pins 62 protruding from an inner peripheral surface of the nozzle body 1. Instead of the second serration, a second protrusion is formed on a peripheral wall of the rotary valve 3. The second protrusion protrudes from an inner peripheral surface toward the center axis. The second protrusion includes pins 65 compressedly fixed to holes 64. The holes 64 are formed at two portions facing each other with respect to the center axis at a peripheral wall of the rotary valve 3.

Second guide grooves 66 are formed on an outer peripheral surface of a tip portion of the needle valve 2. The second guide grooves are engaged with the pins 65 protruding from an inner peripheral surface of the rotary valve 3. The second guide grooves 66 inclines in the opposite direction to the first guide grooves 63 with respect to the longitudinal axis.

In addition, peripheral grooves 67 linked to the downstream end of the fuel inlet passage 11 are formed on an inner peripheral surface of the nozzle body 1, and slits 68 are formed on an outer peripheral surface of the needle valve 2. Upper edges of the slits 68 face the peripheral grooves 67. The slits 68 incline in the same direction as the first guide grooves 63.

When the fuel is supplied under a predetermined pressure or more to the fuel inlet passage 11, the fuel is guided from a gap formed between the outer peripheral surface of the needle valve 2 and the inner peripheral surface of the nozzle body 1 through the peripheral grooves 67 and slits 68 to a gap between the rotary valve 3 and a lower edge of the needle valve 2. The needle valve 2 is subsequently lifted in the axial direction by the fuel pressure against the bias force of the return spring (not shown in the figure).

At this time, the needle valve 2 rotates counterclockwise in the plan view (FIGS. 6B and 6F) due to the engagement of the pins 62 and the first guide grooves 63. The rotary valve 3 whose lifting amount is limited by the fuel pressure axially rotates in the same direction as the needle valve 2 due to the engagement of the pins 65 and the second guide grooves 66. Similar to the first embodiment, the rotary valve rotates by a rotation amount obtained by adding the rotation amount caused by the engagement of the pins 62 and the first guide grooves 63, and the rotation amount caused by the engagement of pins 65 and the second guide grooves 66.

When the fuel flows to the slits 68, the fuel pressure against the inclination of the slits 68 provides the needle valve 2 with a rotational force in the same direction as the rotational direction to lift the needle valve 2.

Thus, in the same manner as the second embodiment, even if the lifting amount of the needle valve 2 can not be obtained sufficiently, the rotation amount may be obtained in proportion to the fuel pressure. Simultaneously, the rotation of the needle valve 2 and the rotary valve 3 can be maintained securely at closed-valve position when the fuel injection nozzle is closed and the fuel pressure is low.

Consequently, in the third embodiment, the same function and effect (fuel injection characteristics and engine operability thereby) can be realized as in the first and second embodiments. Also, because only two sets of pins and of guide grooves need to be working, the manufacturing process becomes easy, and the production costs can be reduced.

The fuel injection nozzle may be capable of rapidly and sufficiently mix the atomized fuel with the air within the combustion chamber, in a wide range of load, i.e., from the low-load region to the high-load region, especially, to contribute greatly to improve the performance during the idle state or the low-load region of the engine.

The fuel injection nozzle may also include an automatic and mechanical rotary structure driven by the fuel pressure without mounting a separate driving device such as a pulse motor.

As explained, the present invention may be applied to a fuel injection nozzle of a direct-injection-type diesel engine of a vehicle and the like. The present invention may be applied to a fuel injector equipped to a pipeline fuel injection device or a common-rail fuel injection device or a unit type fuel injector.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fuel injection nozzle for a diesel engine, comprising:

a nozzle body having a tip end portion, a top end portion having an opening edge, and a fuel inlet passage, the tip end portion having a plurality of first nozzle holes, the nozzle body having a first protrusion formed on a peripheral wall adjacent to the opening edge, the first protrusion protruding from an inner peripheral surface toward a center axis of the nozzle body;

a needle valve inserted in the nozzle body, the needle valve having a tip end portion, a top end portion, a first guide groove formed on an outer peripheral surface at the top end portion of the needle valve and inclining in a direction with respect to an axial direction of the needle valve, and a second guide groove formed on an outer peripheral surface of the tip portion of the needle valve and inclining in an opposite direction to the first guide groove with respect to the axial direction, the tip end portion having a gap with respect to the tip portion of the nozzle body, the first guide groove being engaged with the first protrusion allowing the needle valve to axially rotate corresponding to a movement of the needle valve in the axial direction;

a bag-shaped rotary valve fitted with the tip end portion of the needle valve, the rotary valve having a second protrusion protruding toward the center axis and being engaged with the second guide groove, the rotary valve having a plurality of second nozzle holes configured to have an overlapping area with the plurality of first nozzle holes, the overlapping area increasing as the rotary valve rotates due to the movement of the needle valve in the axial direction.

2. The fuel injection nozzle of claim 1, wherein the first protrusion comprises a pin fixedly fitted to a groove formed on the top end portion of the nozzle body.

3. The fuel injection nozzle of claim 1, wherein the second protrusion comprises a pin fixedly inserted into a hole formed on a peripheral wall of the rotary valve.

4. The fuel injection nozzle of claim 1, wherein each of the plurality of second nozzle holes has an elongated ellipse shape in a rotating direction of the rotary valve, and each of the plurality of first nozzle holes has a round shape having a diameter larger than a width of a narrow side of the plurality of second nozzle holes.

5. The fuel injection nozzle of claim 1, wherein the needle valve has slits on a peripheral wall thereof, the slits inclining in the direction of the inclination of the first guide groove and providing a rotary force to the needle valve by fuel pressure.

6. The fuel injection nozzle of claim 1, wherein the needle valve has a tapered surface at the tip end portion of the needle valve, and the nozzle body has a tapered surface at the tip end portion of the nozzle body, the tapered surface of the nozzle body being in contact with the tapered surface of the needle valve when the needle valve is not rotated.

7. A fuel injection nozzle of a diesel engine, in which a needle valve inserted within a nozzle body is lifted in an axial direction by fuel pressure when fuel is introduced through a fuel inlet passage formed in the nozzle body and a nozzle holder, and the fuel passes through a gap formed between the needle valve and the nozzle body, so as to be injected into a combustion chamber through a plurality of first nozzle holes bored through a wall of the nozzle body, the fuel injection nozzle comprising:

a first serration formed on an inner peripheral surface of a guide ring fitted to a groove formed on the opening edge of the nozzle body, the guide ring being prohibited from rotation, the first serration inclining with respect to the axial direction;

a second serration formed on an outer peripheral surface at the top end portion of the needle valve, the second serration being engaged with the first serration allowing the needle valve to rotate corresponding to movement of the needle valve in the axial direction;

a tip portion on a nozzle hole side of the needle valve having a gap with respect to an inner surface of a tip portion on the nozzle hole side of the nozzle body, the tip portion of the nozzle hole side of the nozzle valve being fitted with a bag-shaped rotary valve;

a third serration and a fourth serration formed on an outer peripheral surface at the tip portion of the needle valve and on an inner peripheral surface of the rotary valve, respectively, the third serration and the fourth serration being engaged with each other with a gap therebetween and inclining in a direction opposite to the first and second serrations with respect to the axial direction; and a plurality of second nozzle holes formed such that an overlapping area of the plurality of second nozzle holes with the plurality of first nozzle holes formed in the nozzle body increases the lifting of the needle valve in the axial direction.

8. The fuel injection nozzle of a diesel engine according to claim 7, wherein each of the plurality of second nozzle holes has a shape of an elongated ellipse in a rotating direction of the rotary valve, and each of the plurality of first nozzle holes has a round shape having a diameter larger than a width of a narrow side of the plurality of second nozzle holes.

9. The fuel injection nozzle of a diesel engine according to claim 7, wherein the first serration is formed on an inner peripheral surface of a guide ring being fitted to a groove formed on the opening edge of the nozzle body, the guide ring being freely rotatable in a predetermined angle in the axial direction, wherein a guide ring spring is disposed for biasing the guide ring toward a direction opposite to the rotating direction of the needle valve when the needle valve is lifted in the axial direction, and wherein one or more slits are formed to a peripheral wall of the needle valve, the slits having a depth that increases toward the rotating direction of the needle valve when the needle valve is lifted in the axial direction, and providing rotary force to the needle valve in the rotating direction by the fuel pressure.

10. The fuel injection nozzle of a diesel engine according to claim 7, wherein corn-tapered surfaces are each formed to the needle valve in an area closer to a base end portion than the third serration portion, and to the inner peripheral surface of the nozzle body in an area closer to the base end portion than an rotary valve mounting portion, the corn-tapered surfaces contacting with each other when the needle valve is not lifted.

11. A fuel injection nozzle for a diesel engine, comprising:

a nozzle body having a tip end portion, a top end portion having an opening edge, and a fuel inlet passage, the tip end portion having first nozzle holes, a guide ring fitted at the opening edge and having a first serration substantially inclined with respect to an axial direction;

a needle valve inserted in the nozzle body, the needle valve having a tip end portion, a top end portion, a second serration formed at the top end portion thereof, and a third serration at the tip end portion thereof, the second serration being engaged with the first serration, the first and second serrations allowing the needle valve to rotate and move in the axial direction creating a first gap between the nozzle body and the needle valve when fuel is introduced through the fuel inlet passage; and a rotary valve disposed between the tip end potion of the needle valve and the tip end portion of the nozzle body, the rotary valve having second nozzle holes in the tip end portion thereof and a fourth serration, the second nozzle holes configured to have an overlapping area with the first nozzle holes, the overlapping area increasing as the needle valve is lifted in the axial direction, the fourth serration being engaged with the third serration with a second gap therebetween and being inclined in a direction opposite to the first and second serrations with respect to the axial direction.

* * * * *